United States Patent [19]

Lundgren

[11] Patent Number: 4,833,957

[45] Date of Patent: May 30, 1989

[54] VISION GUIDED PANEL FABRIC CUTTER

[75] Inventor: Bryan L. Lundgren, South Haven, Mich.

[73] Assignee: Haworth, Inc., Holland, Mich.

[21] Appl. No.: 61,059

[22] Filed: Jun. 10, 1987

[51] Int. Cl.[4] ..... B26D 7/27

[52] U.S. Cl. ..... 83/56; 83/72; 83/282; 83/365; 83/368; 83/370; 83/614; 83/925 CC

[58] Field of Search ..... 83/71, 72, 171, 925 CC, 83/428, 365, 368, 370, 371, 614, 13, 56, 282

[56] References Cited

U.S. PATENT DOCUMENTS

| | | | |
|---|---|---|---|
| 4,071,899 | 1/1978 | Holy | 83/365 X |
| 4,217,492 | 8/1980 | Fayfield | 250/239 |
| 4,356,393 | 10/1982 | Fayfield | 250/214 R |
| 4,453,658 | 6/1984 | Augustin | 225/95 |
| 4,581,965 | 4/1986 | Gerber | 83/56 X |

OTHER PUBLICATIONS

Index page, and pp. 2, 35 and 36 from 1983 Banner Engineering Corp. Cat. Brochure sheet of Hotec, Inc. of Buford, Georgia.

*Primary Examiner*—Frank T. Yost
*Assistant Examiner*—Hien H. Phan
*Attorney, Agent, or Firm*—Flynn, Thiel, Boutell & Tanis

[57] ABSTRACT

Method and apparatus for cutting off selected length panels from an indefinte length strip of fabric with minimum waste, the fabric being comprised as superposed longitudinal and transverse elongate elements, wherein the transverse elements may deviate from strict perpendicularity to the length direction of the strip, e.g., be skewed or bowed. A support defines a path along which the strip of fabric and its longitudinal elements are to extend. A cutter unit is actuable for cutting elements of the strip to cut off a panel from the strip. A transverse moving unit relatively moves the cutter means and strip in a direction transverse to the length of the strip to cut the full width of the strip and thereby separate a panel therefrom. A longitudinal moving unit is actuable for relatively moving the cutter and strip in a direction longitudinal of the strip. A vision guided unit optically responds to deviations in the direction of at least one of the transverse elements of the strip adjacent the cutter for actuating the longitudinal moving unit to relatively move the cutter and strip to enable the cutter to cut the strip substantially along a single transverse element and at least substantially avoid cutting of transverse elements, despite substantially skewing or bowing of the transverse elements out of perpendicularity with the length direction of the strip.

25 Claims, 5 Drawing Sheets

VISION GUIDED PANEL FABRIC CUTTER

FIELD OF THE INVENTION

This invention relates to a machine for cutting of successive panels from a strip of fabric, particularly fabric of the kind comprising side-by-side longitudinal elements crossed by side-by-side transverse elements, typically a woven fabric.

BACKGROUND OF THE INVENTION

Panels cut successively from a fabric strip have been used for example as decorative faces on room divider units, of the kind employed to divide an office space into separate work areas. Such panels are required to be mounted such that the weave aligns with the office divider edge. Previously, the fabric strip was led from a roll past a measuring station and cutting station. The measuring station determined when an adequate length of strip had moved to the cutting station to stop the strip at a proper location so that the desired length of panel would be cut from the strip. An additional length of fabric is added to the current cut in order to compensate for misaligned weave. At the cutting station, a carriage supporting a cutter moved transversely across the strip to sever the panel from the strip.

However, the weave of such fabric will typically distort if locally tensioned. It is thus common for the transverse elements (e.g. yarns or threads) TE (FIG. 1) of the fabric to deviate from perpendicularity to the longitudinal elements LE and length direction A of the strip S at the cutting station. Such deviation may be as shown in FIG. 1, in which transverse elements TE are skewed to slope downward and to the right in the drawing. Alternately, such deviation may involve transverse elements skewed in the opposite direction or bowed either convexly or concavely in the plane of the strip. The cutting tool in the prior apparatus would not cut parallel to such deviated transverse elements, but rather would cut perpendicular to the length direction of the strip and hence at an angle to transverse elements of the strip, and thus cut through a number of said transverse elements as it cut across the strip. However, the longitudinal and transverse elements of the finished panel must lie perpendicularly of each other, to present an acceptable appearance. The panel thus produced by such prior cutting technique, by selective tensioning, could have its transverse elements reoriented to substantial perpendicularity to its longitudinal elements, but only by distorting its perimeter shape from rectangular e.g., to a parallelogram shape as in FIG. 2. The prior technique thus made it necessary to cut a panel P' overlong, with waste (e.g. the waste 57 indicated in FIG. 2) that had to be trimmed therefrom to produce the finished rectangular panel of FIG. 3. The prior technique thus disadvantageously wasted fabric (yielding fewer panels per roll of fabric), required additional manufacturing time and effort to align the fabric to the office partition and thus unnecessarily increased the cost of production of fabric covered office partitions and dividers.

Accordingly, the objects and purposes of this invention include provision of a method and apparatus for cutting a series of panels from the end of a fabric strip, which: (1) avoids the above-mentioned disadvantages of the prior technique; (2) visually tracks and cuts along a transverse element (or an elongate transverse gap between adjacent transverse elements) despite deviation of such transverse element or elongate gap from strict perpendicularity to the length direction of the strip; (3) avoids or minimizes cutting of transverse elements; and (4) permits the cut off panel, by appropriate tensioning, to have initial skewing or bowing of transverse elements removed therefrom and to thereby resume the desired finished rectangular shape without trimming waste fabric therefrom.

In general, the objects and purposes of the invention are met by providing a method and apparatus for cutting off selected length panels from an indefinite length strip of fabric with little or no waste, the fabric being comprised of superposed longitudinal and transverse elongate elements, wherein the transverse elements may deviate from strict perpendicularity to the length direction of the strip, e.g., may be skewed or bowed. The strip is supported with its longitudinal elements aligned along a path. Cutter means are actuable for cutting elements of the strip to remove a panel from the strip. Transverse moving means are provided for relatively moving the cutter means and strip in a direction transverse to the length of the strip to cut the full width of the strip and thereby separate a panel therefrom. Longitudinal moving means are provided for relatively moving the cutter means and strip in a direction longitudinal of the strip. Vision guided means are optically responsive to deviations in the direction of at least one of the transverse elements adjacent the cutting means for actuating the longitudinal moving means to relatively move the cutter means and strip to enable the cutter means to cut the strip substantially along a single transverse element and at least substantially avoid cutting of transverse elements, despite skewing or bowing of such transverse elements from perpendicularity with the length direction of the strip.

DETAILED DESCRIPTION

Figure 1:
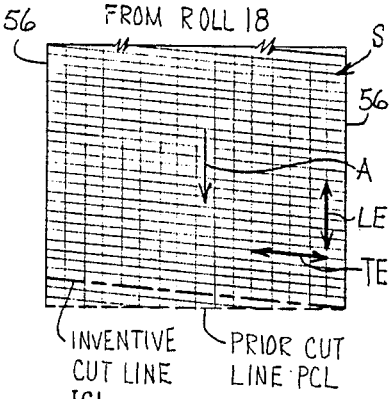
FIG. 1 is a fragmentary schematic top view of a fabric strip to be cut into panels and in which the transverse threads thereof deviate from perpendicularity to the length of the strip, such that in the embodiment shown such transverse threads are skewed.

A fabric cutting machine 10 (FIG. 4) comprises an elongate horizontal base 11 fixedly supported by upstanding legs 12. Roll supports 13 fixedly upstand from opposite sides of the input end portion (rightward portion in FIG. 4) 14 of the base 11.

A strip S of fabric is to be cut into individual panels P of desired length. The strip S is normally wound on a roll 18 for storage and unwound therefrom for cutting into panels P. The roll 18 is supported on a central shaft 19 rotatably mounted on the frontmost (leftmost in FIG. 4) roll supports 13. Rearward pairs of the roll supports 13 may store thereon additional rolls 18' to be subsequently unrolled and cut into panels.

Suitable conveying means forwardly (leftwardly in FIG. 4) advance the leading edge E of the strip S through a measurement station 21 and a cutting station 22, and forward cut panels P therebeyond to a stacker arm 23. The stacker arm 23 centrally folds the panel P and pivots it forwardly onto a movable transport rack 24. A successively stacked pile of panels P on the rack 24 are movable thereby to a further work station not shown, for example for application of the fabric panels P to movable office partitions, for example.

The conveying means may be of any desired type. In the embodiment shown, same are defined by rear, middle and forward belt conveyors 27, 28 and 29 extending horizontally along, and orbitally supported on, the base 11. The belt conveyors 27–29 may be selectively driven by conventional motor means, schematically indicated at CM1, CM2 and CM3 in FIG. 4.

The measurement station 21 measures the length of strip advanced therepast and thus determines when the desired length of strip S is advanced past the cutting station 22. In the embodiment shown, the measuring station 21 comprises a cylindrical transverse measurement roll 32 (FIGS. 4 and 7) rotatably supported at its ends on the base 11 by a suitable bearing means 33 and frictionally engageable on its bottom side with the top of the fabric strip S so as to be proportionally rotated by advancement of the strip S therebeneath. The measuring roll 32 drives a conventional counter or other distance measuring device 34 (FIG. 7) which provides an output indicating that the desired length of strip S has been advanced beyond the cutting station 22. If desired, the output of measuring device 34 at that time may be applied for stopping advancement of the rear conveyor 27, as by shutting off its conveyor motor CM1.

To assure reliable friction driving contact of the measuring roll 32 with the top of the strip S, the strip S is preferably firmly backed, for example by providing a backing roller 31 (FIG. 7) snugly sandwiching the strip S and upper reach of the conveyor 27 between itself and the measuring roll 32.

Figure 4:
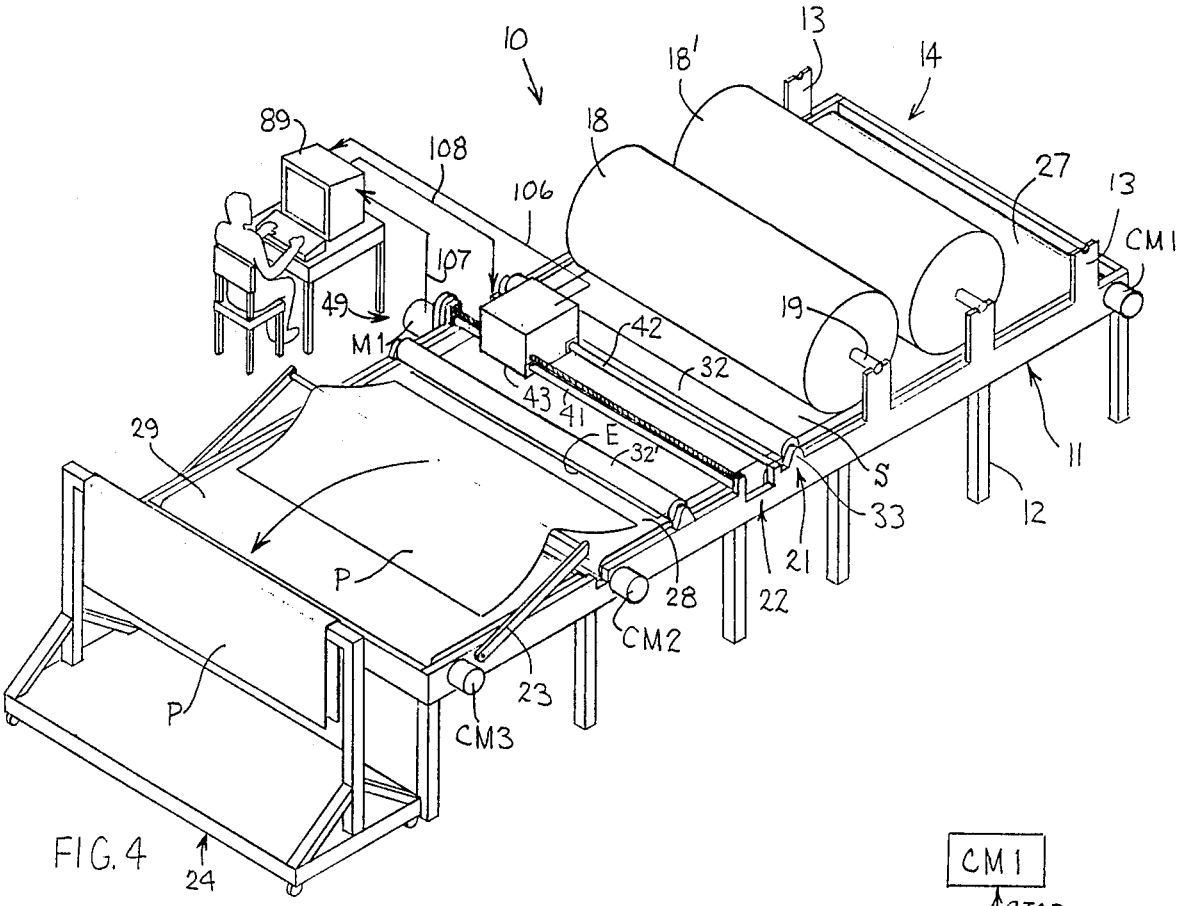
FIG. 4 is a pictorial view of an apparatus embodying the invention.
Figure 7:
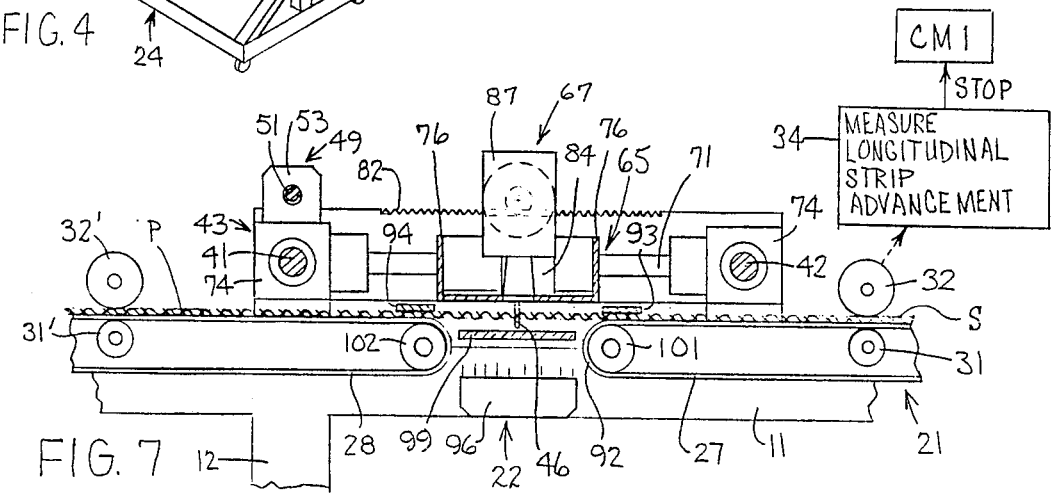
FIG. 7 is a fragmentary cross sectional view substantially taken on the line VII—VII of FIG. 5, and generally looking leftward transversely of the cutting station of the FIG. 4 apparatus.
Figure 5:
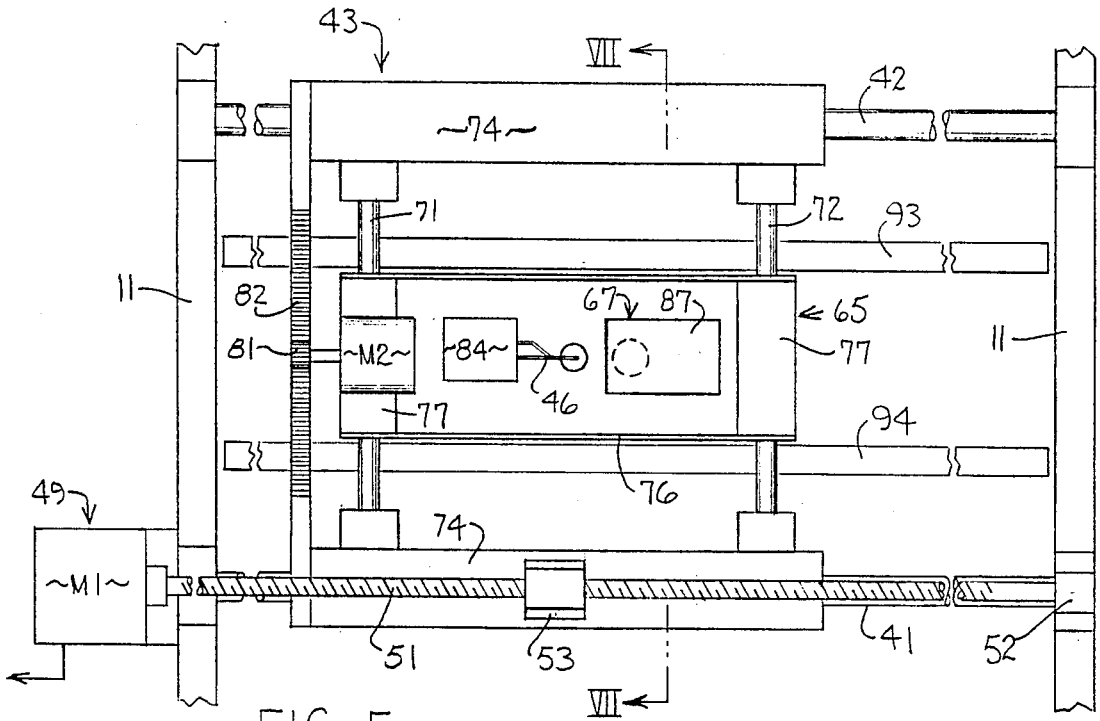
FIG. 5 is a fragmentary enlarged top view of portions of the apparatus concerned with longitudinal and transverse movement of a fabric cutter and optical sensor.
Figure 6:
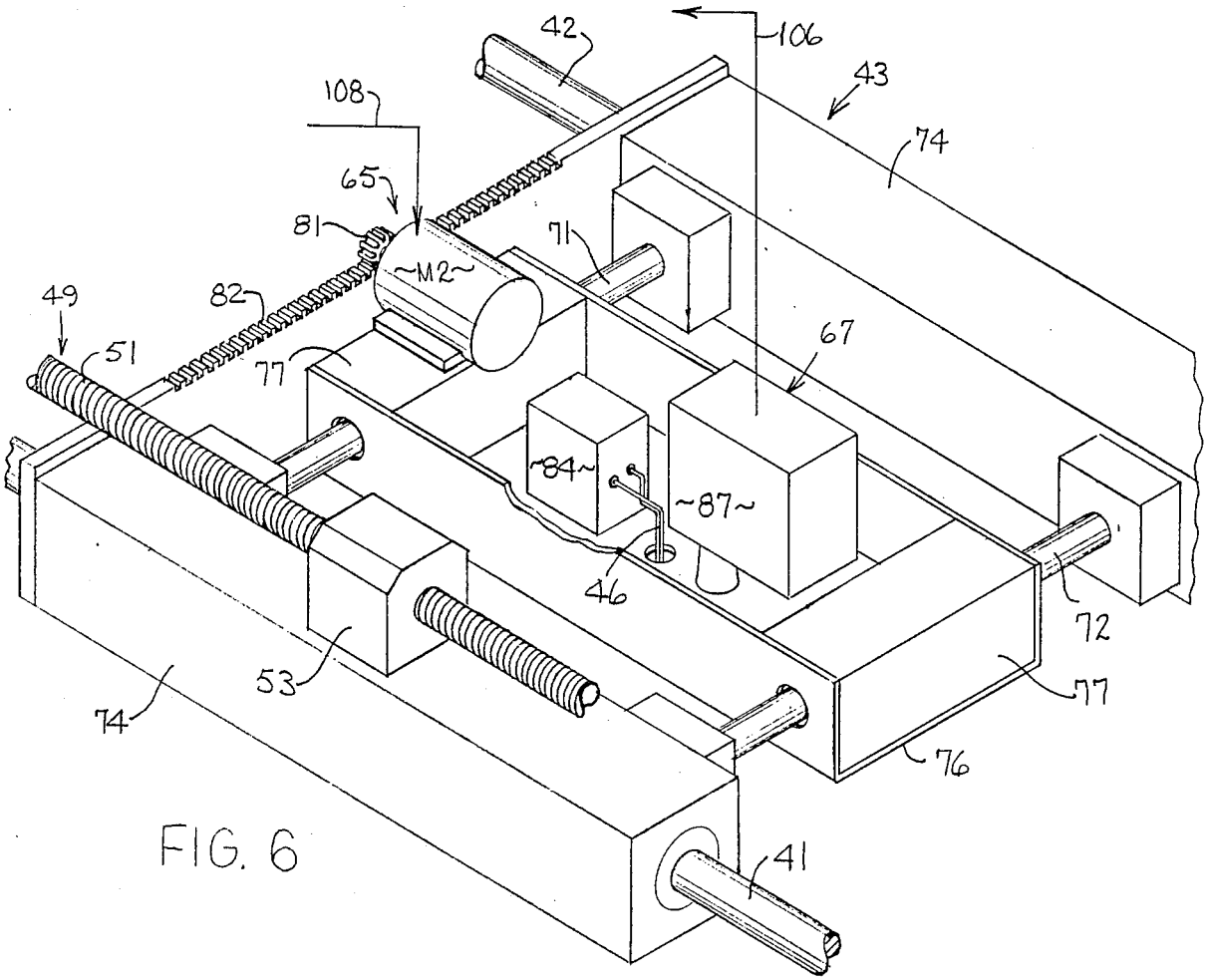
FIG. 6 is an enlarged pictorial view, taken generally from the top thereof, of the FIG. 5 structure.

FIGS. 5 and 7 show similar rollers 31' and 32' associated with the conveyor 28, to assure firm forwarding contact of a cut off panel with the conveyor 28. In the present FIGS. 4–12 embodiment the rollers 31' and 32' can be omitted if desired, their primary purpose being hereafter discussed with respect to the FIG. 13 modification.

The cutting station 22 comprises parallel front and rear guide rods 41 and 42 (FIGS. 4 and 7) extending transversely across the base 11 above the conveyors 28 and 27. The rods 41 and 42 define a horizontal plane parallel to the plane of the upper reaches of the conveyors, such that the strip S entering the cutting station 22, and cut off panel P leaving the cutting station 22, pass beneath the guide rods 41 and 42. The guide rods 41 and 42 are perpendicular to the length direction of the base 11 and strip S to be cut.

A first carriage 43 is slidable along the guide rods 41 and 42 and hence transversely of the strip S and base 11. The first carriage 43 ultimately supports a cutting means 46 capable of transversely cutting the fabric to sever a panel P from the strip S.

A transverse moving unit 49 is actuable for moving the carriage 43 transversely over the strip S and along the guide rods 41 and 42. In the embodiment shown, the transverse moving unit is of screw type, comprising a motor M1 actuable to rotatably drive an elongate screw 51. The screw 51 is supported at its opposite ends respectively by the upper portion of the motor M1 and by a suitable bearing 52 on the opposite side of the base 11. The screw 51 threadedly engages a nut 53 fixed atop the carriage 43. Thus, actuation of the motor M1 rotates the screw 51 which transversely moves the nut 53 and carriage 43 in a direction corresponding to the rotate direction of the motor M1. This moves the cutter means 46 transversely across the strip S to sever a panel P therefrom.

Figure 2:
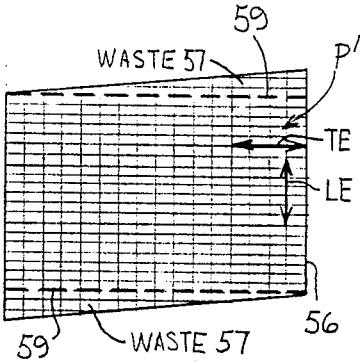
FIG. 2 is a top view of a panel cut from the FIG. 1 strip using a prior method and apparatus.
Figure 3:
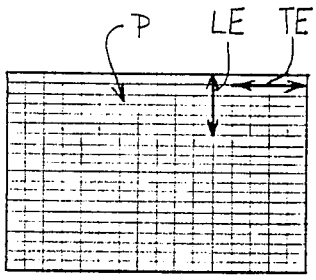
FIG. 3 is a schematic top view of a panel of fabric cut from the strip in accord with the method and apparatus of the present invention.

To the extent above discussed, the apparatus is conventional and of the type more generally described above in the BACKGROUND OF THE INVENTION. The foregoing conventional apparatus thus creates significant amounts of fabric waste 57 (FIG. 2) when cutting panels P from a strip S in which the transverse elements (e.g. yarns or threads) TE deviate from perpendicularity to the length direction of the strip S. The strip S typically is a woven fabric and relatively soft and flexible and the transverse elements TE thereof can readily be accidently pulled, for example by uneven tension across the transverse width of the strip, so that such transverse elements TE deviate from strict perpendicularity to the length direction A of the strip S, e.g., be skewed or bowed as above described. The present invention is intended to produce finished panels P from a strip S whose transverse elements TE deviate from strict perpendicularity to the length direction of the strip S, during the initial cutting of the panel P from the strip S and without going through the waste creating and trimming steps of the prior method and apparatus as above discussed with respect to FIGS. 1–3. More particularly, the present invention is intended to sever the panel P from the leading end of the strip S by cutting along the inventive cut line ICL in FIG. 1, not the prior cut line above discussed and indicated at PCL. Such inventive cut line ICL follows along one of the transverse elements TE (or between two immediately adjacent transverse elements TE), and thereby avoids cutting (or least significant cutting) of transverse elements TE, despite deviation of said transverse elements TE from strict perpendicularity to the length direction A of the strip S. The inventive cut line ICL will be skewed or bowed or otherwise deviate from perpendicularity with the length direction of the strip in accord with the deviation of the immediately adjacent transverse element or elements. Thus, the resulting panel P may be in parallelogram form or other distorted form (not shown) immediately after cutting from the strip S, but panel P can immediately be made rectangular by selective momentary tensioning of its transverse elements TE, to present the appearance at P in FIG. 3. In this way, the present invention immediately produces, with a single cut, a panel P presenting the desired regular, rectangular grid appearance of elements TE and LE possessed by the panel P of FIG. 3.

The present invention provides means 65 (FIGS. 5–7) for shifting the cutting means 46 longitudinally with respect to the strip S as it moves transversely of the strip. The present invention provides means 67 for detecting deviation of the transverse elements TE closest to the cutting means 46 and thereby causing the longitudinal moving means 65 to move the cutting means 46 longitudinally in a direction (forwardly or rearwardly) to compensate for that deviation, i.e., so that the cutting means 46 tends to cut longitudinal elements between the same pair of transverse elements all the way across the width of the strip S and avoid, or at least to minimize, cutting of transverse elements TE as it cuts from one side of the strip S to the other.

In the embodiment shown, the longitudinal moving means 65 comprises a longitudinally extending pair of guide rods 71 and 72 perpendicular to and spanning the space between the transverse guide rods 41 and 42. The ends of the longitudinal guide rods 71 and 72 are fixed to linear bearing units 74 which slideably support the first carriage 43 on the transverse guide rods 41 and 42. A second carriage 76 extends between linear bearing units 77 longitudinally slidable on the longitudinal guide rods 71 and 72. The cutting means 46 is fixedly mounted on the carriage 76 for engaging and cutting the fabric strip S, which underlies the second carriage 76. A reversible motor M2 is actuable to forwardly and rearwardly (longitudinally) move the carriage 76 and hence the cutting means 46, with respect to the underlying strip S. In the embodiment shown, the motor M2 is a conventional stepper motor. Stepper motor M2 positively drives the second carriage 76. In the embodiment shown, the output shaft of the motor M2 rotates a pinion gear 81 drivingly engaging a rack 82 fixed to and extending longitudinally of the first carriage 43. Thus, the cutting means 46 is movable transversely of the strip S by the first carriage 43 and longitudinally of the strip S by the second carriage 76.

In the embodiment shown, the cutting means 46 is a rigid, vertical, hot wire member extending down through the plane of the strip S and capable of cutting, by melting action, of synthetic fiber strips S. The hot wire cutter member 46 is heated by a conventional heating current supply transformer unit 84. Other types of cutting means 46 can be substituted as desired, e.g. a rotating or reciprocing knife blade (not shown).

The means 67 for detecting deviation comprises an optical sensing unit 87. In the embodiment shown, the optical sensing unit 87 comprises a conventional video camera aimed downward through an opening in the bottom of the carriage 76 and suitably lensed to focus on the fabric strip S located close therebeneath, as shown in FIG. 7. The output signal of the camera 87 varies in response to deviations of new transverse elements TE from perpendicularity to the length dimension of the strip S.

In the preferred embodiment shown, the optical sensing unit 87 views the strip close ahead of the cutting means 46, along the line of cut ICL. The conveyors 27 and 28 are separated by a longitudinal gap 92 above which is centrally located the cutting means 46 and optical sensing unit 87. The longitudinal span of the gap 92 is sufficient to allow the cutting means 46 and optical sensing unit 87 to shift longitudinally forwardly or rearwardly over a substantial distance to follow deviations from perpendicularity in the transverse elements TE during transverse cutting of the strip S. Two of many possible tracks that can be followed by the optical sensing unit 87 and cutter means 46 are indicated in broken lines at CT and CT' in FIG. 8.

Figure 8:
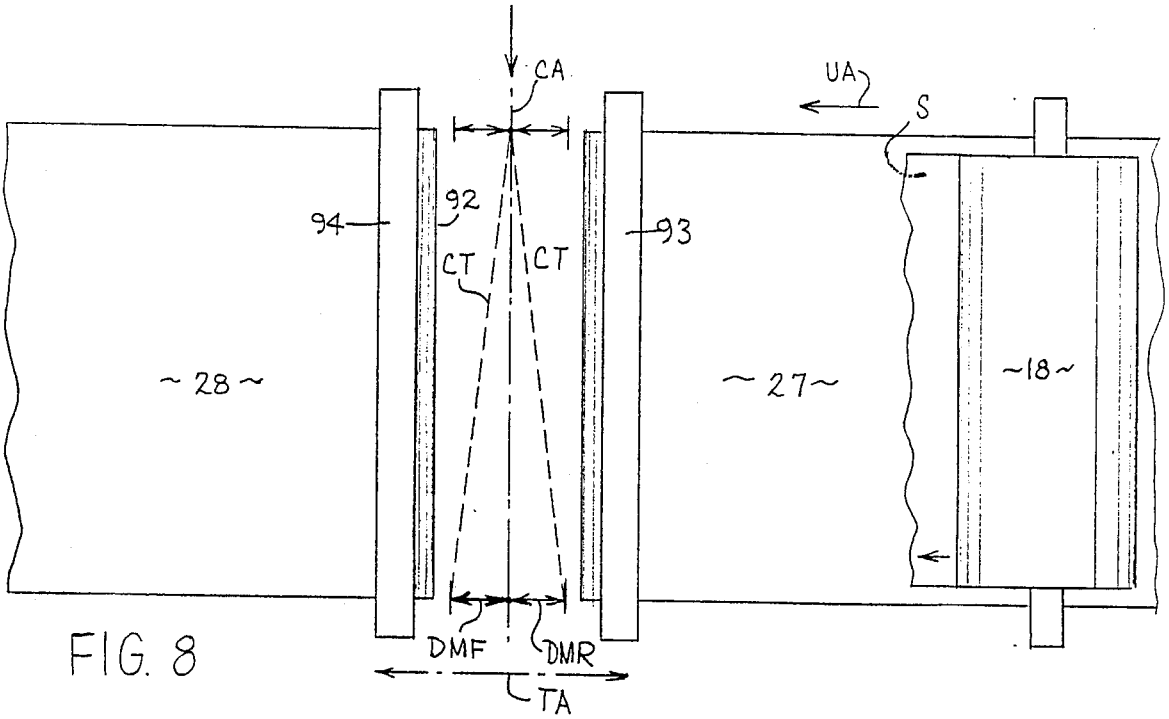
FIG. 8 is a schematic top view of the cutting station with the FIG. 6 structure removed therefrom for a clearer view of parts located therebeneath, and specifically showing the upward light receiving gap and fabric strip clamps.

Referring to FIG. 8, it is convenient to refer to an unroll axis UA along which the strip S is removed from the roll 18, namely an axis extending in the longitudinal direction of the apparatus. It is also convenient to speak of a cross cut axis CA, namely an axis extending perpendicular to the unroll axis UA and hence perpendicular to the length direction of the strip S. It is further convenient to speak of a transverse element (e.g. yarn or thread) tracking axis TA, which corresponds to the direction of deviations of the transverse elements TE from perpendicularity to the length direction of the strip S, such tracking axis TA are thus being parallel to the unroll axis UA.

Oriented to shine upward through the gap 92 (FIG. 7) is an elongate, transversely extending light source 96 which extends the full width of the strip S to backlight the strip S below the optical sensing unit 87 as the latter travels with the cutting means 46 transversely of the strip S. The light from source 96 shines upward through openings in the weave of longitudinal and transverse elements LE and TE on the strip S. Accordingly, the downwardly aimed optical sensing means 87 sees a line of corresponding light spots 98 (schematically shown in FIGS. 11A and 11B) between each adjacent pair of transverse elements TE (FIG. 1).

Alternately, small light (not shown) can be fixed below camera 87 and strip to travel with second carriage 77.

Figure 11A:
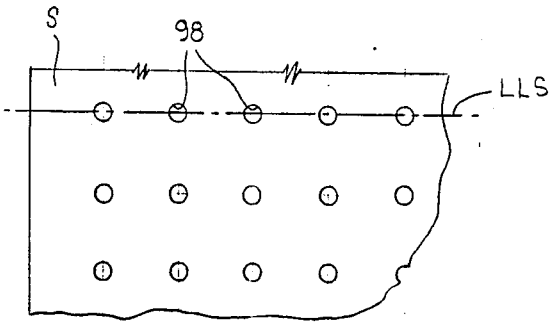
FIGS. 11A and 11B are schematic fragments of the fabric strip of FIG. 1 much more highly enlarged than in FIG. 9B and showing a pattern of light spots for transverse strip elements which are respectively perpendicular to the length direction of the strip and skewed.

In FIG. 11A a line LLS of light spots extends perpendicular to the length direction of the strip S and hence parallel to the desired cross cut axis CA. The line of light spots thus does not deviate from perpendicularity to the length direction of the strip. No deviation being present, no compensation for deviation is required. Thus, no actuation of the longitudinal moving motor M2 is needed nor does the second carriage 76, with its optical sensing unit 87 and cutting means 46, need be moved along the longitudinal guide rods 71 and 72. Thus, the apparatus can act like the prior one wherein the cutting means 46 merely travels transversely with the first carriage 43 upon actuation of the first motor M1, to cut a panel P from the strip S.

Figure 11B:
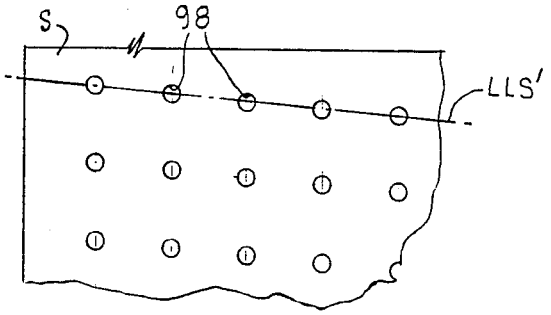

On the other hand, FIG. 11B shows a line LLS' of light spots downwardly and rightwardly skewed with respect to the length direction of the corresponding strip S, like in FIG. 1, indicating deviation of the transverse elements of that FIG. 11B strip S from perpendicularity with the longitudinal direction of the strip S. Such indicates a need for compensation by shifting the cutting means 46 along the tracking axis TA, i.e., longitudinally of the strip S, as it moves transversely of the strip S along axis CA, so that the cut will be parallel to the light spots line LLS' and hence tend not to cut any of the transverse elements TE of the strip S.

As seen in FIG. 7, a transparent window 99 preferably extends substantially the width of the slot 92 to prevent the leading end of the strip S, after a panel P is severed therefrom, from falling down into the gap 92. The window 99 thus helps the cut end E of the strip S to bridge the gap 92 to the downstream conveyor 28 for advancing leftwardly, to enable latter cutting of a new panel from the strip S. The transparency of the window 99 permits the light from the light source 96 to illuminate the downwardly looking optical sensing means 87 as above described.

However, a fixed window is not mandatory. It is contemplated that the window may be replaced by an upward directed air blower or a flip-up "window" to help the fabric strip to bridge the gap when the conveyors are forwarding prior to cutting the next panel. Alternately, the window 99 can be replaced by gripper means to reach upstream to grip the cut edge E of the strip S, such as a precision stacker of the brand manufactured by Spuhl-Anderson of Chaska, Minn.

In accord with the broader aspects of the present invention, it is contemplated that the transverse elements themselves can be tracked or a line LLS of lights between transverse elements can be tracked by the optical sensing unit 87, as in the disclosed embodiment.

Transverse clamps 93 and 94 are disposed beneath the carriage 76 and above the strip S. After a sufficient length of strip S has been advanced forwardly beyond the cutting means 46 to provide a proper length panel P, and before starting cutting of the strip S the conveyors 27 and 28 are stopped. Then, the transverse clamps 93 and 94 are, by any convenient means not shown, firmly lowered as top the strip S at the rear and front edges of the gap 92. The lowered clamps 93 and 94 firmly hold the strip S down against the then stopped top reach of the conveyors 28 and 27 respectively so as to frictionally immobilize the strip S over the gap 92, so that it can be cut by the cutting means 46. When endless belt conveyors like those at 27 and 28 are used to advance the strip, it is convenient to locate the clamps 93 and 94 above the conveyor rollers 101 and 102 flanking the gap 92 to firmly support the upper reach of the conveyors 27 and 28, the strip S and the clamps.

Control of the conveyor motors CM1–CM3, clamps 93 and 94, and transverse moving motor M1 may be manual or by any automatic means. Such automatic means are not necessary to the present invention and hence are not shown in any detail.

Figure 12:
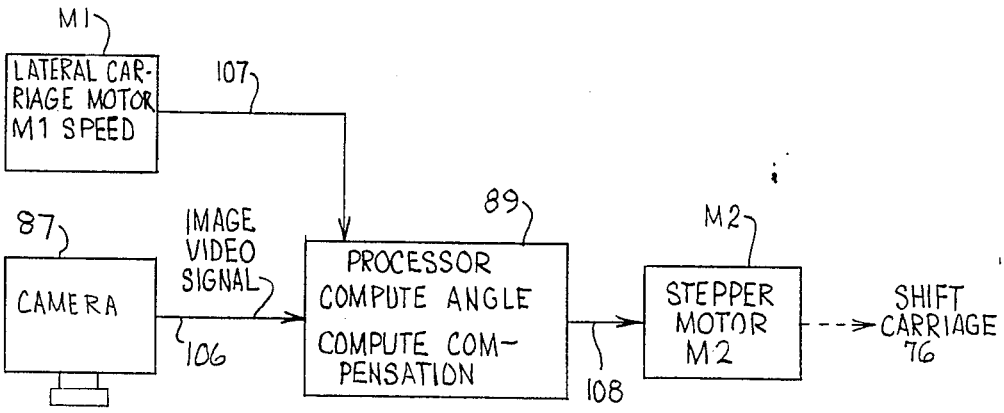
FIG. 12 is a schematic diagram relating the output of an exemplary optical sensing means to an exemplary means for longitudinally shifting the cutter in a direction to compensate for deviation of a line of light spots from perpendicularity to the length direction of the strip.

The means 67 for detecting deviation here further includes a programmed personal computer or the like, generally indicated at 89 in FIGS. 4 and 12. The computer 89 responds to such variations in the output signal of the camera 87 to cause the motor M2 to longitudinally shift the second carriage 76, and hence cutting means 46, in a direction and for a distance to compensate for such deviations of adjacent transverse elements TE of the strip, such that the cutting means 46 tends to follow the inventive cut line ICL of FIG. 1.

More particularly, an image video signal from the optical sensing unit 87 is applied through an electronic signal path 106 (FIGS. 4 and 12) to the programmed computer 89. A signal representing the speed of the lateral carriage motor M1 is applied through a further signal path 107 to the computer 89. The computer 89 detects the deviation of the transverse element TE (or the line of light spots LLS') along the line of cut and through a signal path 108 signals the stepper motor M2 to shift the second carriage 76 (and hence cutting means 46 and optical sensing unit 87) longitudinally in a direction and for a distance to compensate for such deviation.

Figure 9A:
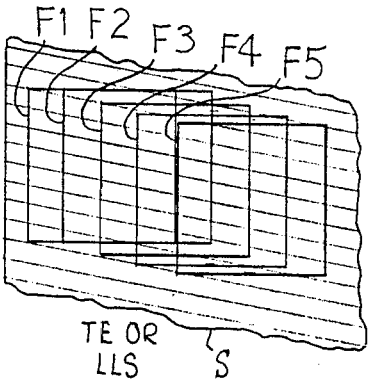
FIG. 9A shows an enlarged fragment of the FIG. 1 fabric strip with an example of a series of successively taken video camera frames superposed thereon.
Figure 9B:
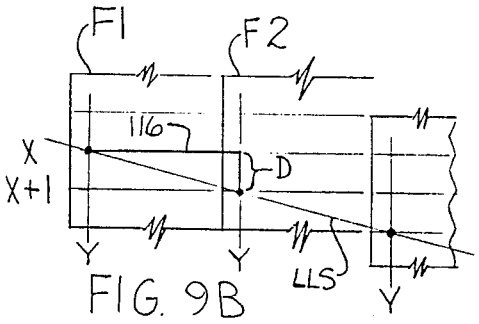
FIG. 9B is an enlarged fragment of FIG. 9A showing the axis of a series of light dots between adjacent transverse strip threads with scan lines of the video camera scanning raster superposed thereon.
Figure 10:
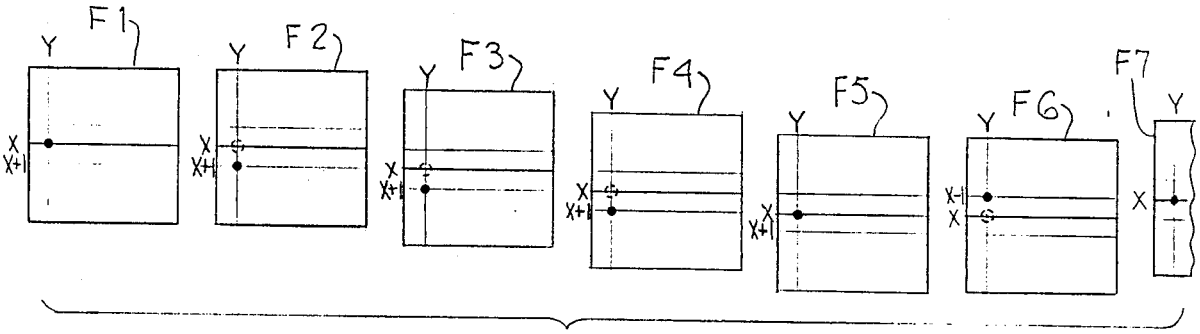
FIG. 10 is a separated view of a succession of a camera frame similar to that shown in FIG. 9A showing the deviation and location of light spots of a transverse line of light spots along the vertical line Y in the camera field as the camera scans transversely of the fabric strip.

Various techniques may be utilized to find the deviation of a transverse element TE or line LLS of light spots from perpendicularity with the length direction of the strip S. However, in the embodiment shown, in which the optical sensing unit 87 is a video camera, it is convenient to operate the camera to take a series of distinct still photographs of the strip S as it is moved generally transversely across the trip S by the transverse moving motor M1. This can be accomplished, for example, by equipping the camera with a periodically actuated shutter (not shown) or by making the light source 96 a periodically actuated flash tube of the conventional type which periodically and for a very short time emits successive light flashes each sufficient for the camera to scan through at least a major portion of a camera scanning field or frame. The transversely moving camera 87 thus in effect takes a series of still pictures, which preferably overlap, of portion of the strip S adjacent and preceding the cutting means 46. The resulting "pictures" for example include the series of camera frames F1–F5 of FIG. 9A. The corresponding frames F1–F5, along with additional ones F6 and F7, are also shown in FIG. 10. Thus, in the embodiment shown in FIGS. 9B and 10, a camera horizontal scan line X crosses a line of light spots LLS (FIGS. 9B and 10) at a horizontal location Y in the scanning frame F1 of the camera. The location of the crossing in the camera frame is thus known from the X and Y values.

The overlap of successive frame F1, F2 . . . must be such that ½ the spacing between adjacent lines LLS of light spots does not shift between successive frames F1, F2 . . . . This requirement eliminates ambiguity as to which line LLS of light spots is being viewed and whether the deviation of the line LLS is positive or negative.

Assume that the line LLS deviates from perpendicularity to the length direction of the strip S, for example by being skewed downwardly and rightwardly as in FIGS. 9 and 10. Accordingly, in the next camera frame F2 (which preferably is timed to approximately half overlap the first frame F1), the line LLS of light spots crosses the horizontal location Y not at vertical location X, but at rather a different (here lower) vertical location X+1. This means that the line of light spots LLS is indeed deviating from perpendicularity to the length direction of the strip S. Accordingly, analysis of the camera video signal on line 106 by the computer 89 determines that it is necessary to laterally shift the cutter means 46, optical sensor 87 and second carriage 76 in a direction (namely forwardly or downwardly in FIG. 10) to compensate for this deviation. Accordingly, the computer 89 through line 108 actuates the stepper motor M2 to shift the carriage 76 in a compensating direction, here forwardly (downwardly in FIGS. 9 and 10). Thus, the next camera frame F3 is itself stepped forwardly to more closely follow the line of light spots LLS or corresponding transverse elements TE. Accordingly, the cutting means 46 tends to longitudinally follow a deviating line of light spots LLS (or corresponding adjacent transverse element TE).

By making the camera frames F1–F5 relatively small (compared to the width of the strip S), and by overlapping same as shown such that the deviation of the inspected line of light spots LLS (FIG. 11B) does not deviate more width ½ the spacing between adjacent lines LLS, the system can tell the monitored line LLS from the adjacent lines LLS. Thus, it is possible to cause the cutting means 46 to closely track along a desired line of light spots LLS or transverse element TE of the strip S, while severing a panel P from the strip S, and thereby produce a panel P in the shape of the finished FIG. 3 rectangle rather than in the wasteful prior parallelogram or other shape as in FIG. 2.

A suitable video camera 87 and computer 89 may be purchased together in the form of an Itran VIP I or II inspection system available from Itran Corporation of Manchester, N.H. On the other hand, use of optical sensing means 87 other than a television camera and use of other control means are contemplated. In FIG. 9B, it can be seen that the amount of deviation D from perpendicularity of the line of light spots LLS, with respect to the length direction of the strip, corresponds to the steepness of the slope (skew) of the line LLS and with such slope and the distance between successive camera frames F1, F2, indicated at 116, defines a triangle, i.e. the frame offset 116 and deviation D together defining the slope of the line of light spots LLS.

In one embodiment, the fabric strip S was 69 inches wide and it was desired to be able to cut the fabric strip S to the tolerance of 0.2 inches from perpendicularity of the cut edge with respect to the length direction of the strip S. The hot wire cutter means utilized stamped 18 gauge nichrome blade. Desired unroll speed (speed of taking the strip S from the roll 18) was preferably in the range of 10 inches to 99 inches per second with the longitudinal panel extent preferably being in the range of 0.1 inches to 99.9 inches. The cross speed (transverse cutting speed) was preferably in the range of 1.0 to 36.0 inches per second. It was preferred that the forward and rearward deviation maximum DMF and DMR each be 3 inches for total deviation of 6 inches maximum (FIG. 8).

The following were exemplary camera parameters:

CAMERA FIELD OF VIEW:
Note: Camera 87 is mounted on the cutter 176 carriage.
Assume:
- 5 minimum yarns in frame
- 10 maximum yarns in frame
- 20 yarns (average) per inch of fabric Spot size range:

| | | |
|---|---|---|
| | 5 | yarns per frame |
| / | 20 | yarns per inch |
| | 0.25 | inch frame size minimum |
| | 10 | yarns per frame |
| / | 20 | yarns per inch |
| | 0.50 | inch frame size maximum |

FRAME PROCESSING RATE:
Assume: 50 percent frame overlap

| | | |
|---|---|---|
| | 7.5 | inch per second cut speed |
| / | 0.25 | inch frame size |
| / | 0.5 | frame overlap |
| | 60 | frames per second maximum |
| | 7.5 | inch per second cut speed |

-continued

| | | |
|---|---|---|
| / | 0.50 | inch frame size maximum |
| / | 0.5 | frame overlap |
| | 30 | frames per second minimum |

PIXEL AND GRAY SCALE:
Assume:
- 10 yarns per frame
- light between yarns is 15 percent of yarn width
- 256 × 256 pixel frame
- 64 level gray scale

| | | |
|---|---|---|
| | 256 | pixels per frame |
| / | 10 | yarns per frame |
| x | 0.85 | yarn width |
| | 22 | pixel yarn width |
| | 256 | pixel per frame |
| / | 10 | spaces per frame |
| x | 0.15 | space width |
| | 4 | pixel space width |

YARN SKEW AND BOW
Assume: -Yarn skew or linear deviation from 90° can be a maximum of ⅜" per each 12".
-Yarn bow or curvelinear deviation can be a maximum of ⅜" per 12".

$$\frac{0.375 \text{ inch skew}}{12 \text{ inch across}} = \frac{x \text{ pixel skew}}{256 \text{ pixels across}}$$

x = 8 pixel skew per 256 pixel row length
Assume that bow is additive to skew and occurs at the 6" point of the standard foot.
It can approximately triple the possible maximum deviation.
Maximum bow and skew = 24 pixels per 256 pixel row length While the operation of the apparatus will be clear from the foregoing discussion, the same may be broadly summarized to include by the following characteristics.

1. Capture frame from moving cutting carriage camera using a backlite flash tube for freeze frame elimination.

2. Sense the deviation D (FIG. 9B). Repeat steps 1 and 2.

3. When a thread TE moves a pixel, divide by the time (pixel deviation per second) and multiply by the pixel dimension (inch per pixel) to find the rate of deviation (inch per second) and direction (arithmatic sign). This is the current "error" value at the camera on the cutting carriage.

4. Sum the deviation area into a deviation rate register and sum the deviation rate to a cutter axis rate register. Repeat the foregoing for each frame.

OPERATION

To briefly summarize the overall operation of the disclosed apparatus, the forward end of a strip S of fabric is pulled forward from a fabric roll 18 rotatably supported on the input end portion 14 of the base 11. The carriages 43 and 76 are initially located so that the cutting means 46 is centered on the cutting axis CA (FIG. 8) in the middle of the gap 92, and located beside (above in FIG. 8) the strip S. The strip end E is advanced by the conveyor 27 (driven by motor CM1) beneath the raised rear clamp 93, across the glass window 99, and is picked up and forwarded beneath raised front clamp 94 by the conveyor 28 (driven by its motor CM2). The measuring roller 32 measures the forward advance of the strip S and through conventional means 34 causes the conveyor motor CM1 and CM2 to stop the conveyors 27 and 28 when a length of strip S corresponding to the desired longitudinal extent of a panel P has advanced past the cutting means 46.

In preparation for cutting the panel P from the strip S, the normally raised clamps 93 and 94 are lowered to press the fabric strip S positively against the tops of the conveyors 27 and 28 in the region of rollers 101 and 102. This anchors the strip S for cutting.

The optical sensing means 87 and cutting means 46 are actuated. The transverse moving motor M1 is actuated to cause the first carriage 43 to start movement transversely (perpendicularly) across the strip S. The strip S is backlighted by the light source 96. By flashing the light source or periodic actuation of a shutter on the camera, the camera takes a series of overlapping "pictures" F1, F2 . . . during transverse movement of the first carriage 43 across the strip S. The pictures F1, F2 . . . , each constitute a video frame, and focus on lines of light spots, one of which lines is indicated at LLS in FIG. 9B. By comparing the video signal from the camera for successive frames F1, F2 . . . the computer 89 determines the deviation D (FIG. 9B), if any, of the line of light spots LLS and actuates the longitudinal moving motor M2 to longitudinally shift the second carriage 76 (and thereby the cutting means 46 and optical sensing means, or camera, 87) to tend to reduce the deviation D, i.e. so that the selected line LLS of light spots tends to cross substantially the same scan line X (FIG. 9B) at the same horizontal location Y in each successive frame F1, F2 . . . or at least tends to approach that positioning.

As a result, the cutting means 46 tends to cut the strip along the selected line LLS of light spots (or corresponding adjacent transverse elements TE) despite skewing or bowing of the adjacent transverse elements TE of the strip S. Accordingly, the panel P is cut from the end of the strip S along the inventive cut line ICL of FIG. 1, rather than along the prior cut line PCL of FIG. 1. Merely by appropriate tensioning of the cut off panel P, the panel P assumes the rectangular perimeter shape and rectangular grid-like arrangement of its longitudinal and transverse elements LE and TE shown in FIG. 3, all without the need to trim off waste 57 as in FIG. 2.

Once the panel P is cut off, actuation of the conveyor motor CM2 and CM3 causes the conveyors 28 and 29 to locate the panel P centrally over the stacker arm 23 which can then be actuated to pick up and transfer the folded panel P to the rack 24 in a conventional manner, for moving to a subsequent work station.

MODIFICATION

It is contemplated that the disclosed panel cutting apparatus can readily be modified for longitudinal slitting of the strip S. This can readily be accomplished by in effect rotating the above discussed second carriage 76, its longitudinal guide rods 71 and 72, and rack plate 82, as a unit, counter-clockwise through 90° to the position shown in FIG. 13 and then supporting the guide rods 71 and 72 and bracket plate 82 fixedly on the first carriage 43 (e.g. on the linear bearing units 74 thereof). The linear bearing units 74 of FIG. 13 are somewhat more widely spaced than in FIGS. 5 and 6, in order to receive therebetween the rotated second carriage 76, guide rods 71 and 72 and rack plate 82.

Figure 13:
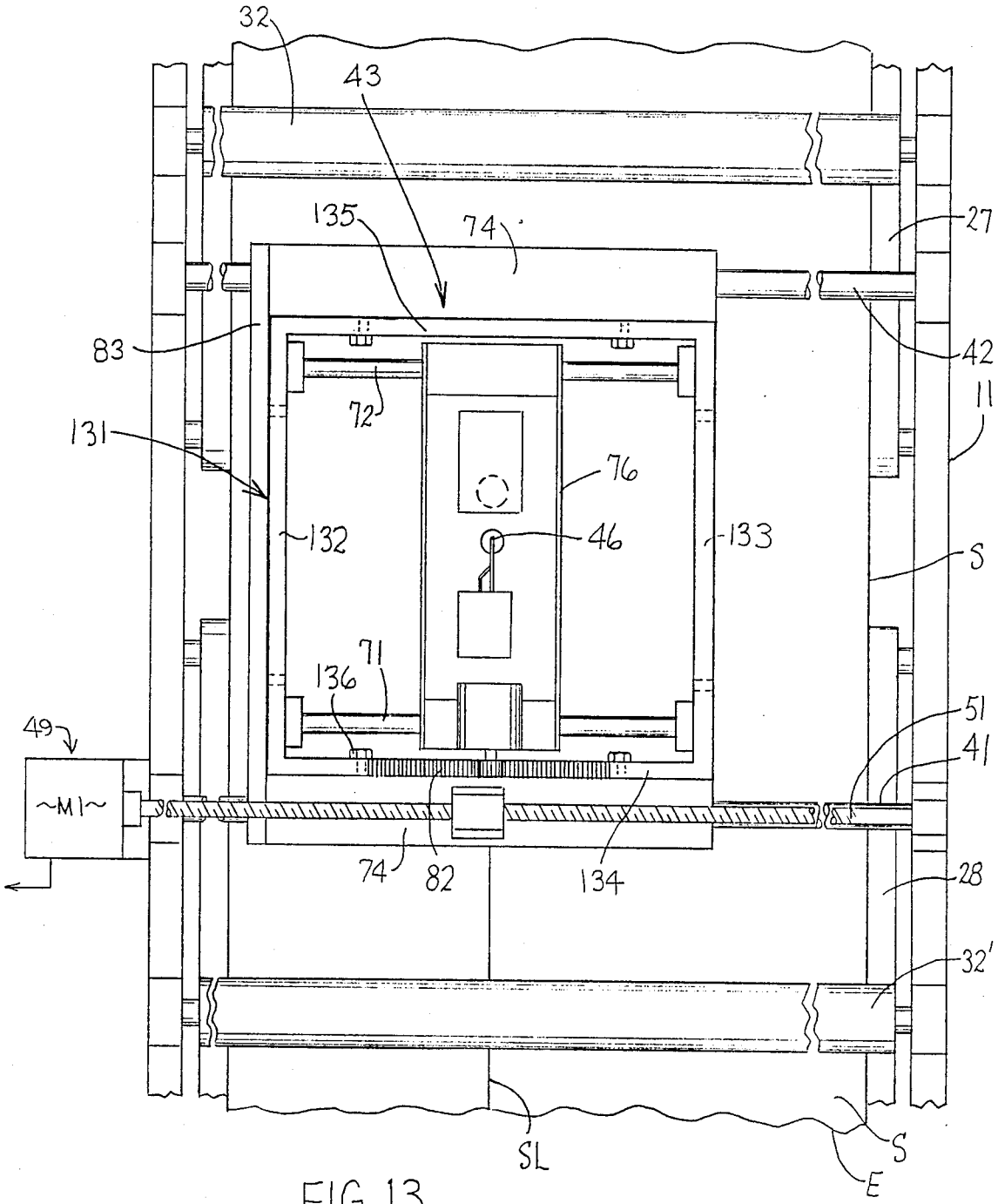
FIG. 13 is a view similar to FIG. 5 but showing a modification.

It is convenient if the second carriage 76 can be switched back and forth between its FIG. 5 and FIG. 13 orientations to allow alternate use of the apparatus as a panel cut-off tool (FIG. 5) and as a strip slitting tool (FIG. 13). This could conveniently be done for example by mounting the guide rods 71 and 72 and rack plate 82 on a turntable (not shown) rotatably mounted on a first carriage 43.

Alternately, and as shown in FIG. 13, the ends of the longitudinal guide rods 71 and 72 may be fixed to opposite sides 132 and 133 of a vertically open square box frame 131. A third side 134 of the square box frame 131 carries the rack 82 on its top edge. The square box frame 131 is removably fixed, as by screws 136 through openings (not shown) in its opposed sides 134 and 135, to the lower bearing unit 74 to thus fixedly mount the longitudinal guide rods 71 and 72 and rack 82 on the first carriage 43. By removing the screws 136, the square box frame 131 can be picked up out of the first carriage 43, rotated back 90° clockwise, dropped back between the linear bearing units 74 and fixed thereto by the screws 72 extending through corresponding holes (not shown) in the remaining side walls 132 and 133 of the square box frame 131 to convert the FIG. 13 longitudinal slitting apparatus back to a transverse panel cut off device of the kind above-described with respect to FIGS. 5–7.

To maintain the rigidity of the first carriage 43 of FIG. 13, a connector plate 83 is fixed at its opposite ends to the linear bearing 74 just as in FIG. 5, except that in FIG. 13 it is no longer necessary for the connector plate 83 to carry the rack 82 as in FIG. 5. The cutting means 46 is preferably centered in the square frame 131 of FIG. 13 so as to stay substantially centered in the gap 92 between the conveyors 27 and 28 both while the apparatus is positioned for slitting as in FIG. 13 and for transverse panel cut off as in FIG. 5.

For slitting, the strip S is pulled forwardly (toward the bottom of FIG. 13) past the cutting means 46 and the second carriage 76 is shifted along its guide rods 71 and 72 much as above described with respect to FIGS. 1–12 to assure slitting along a single line of light spots (here running longitudinally of the strip) or along a single longitudinal element LE of the strip S.

To forward the strip S past the cutting means 46, the leading edge E of the strip S is preferably pressed against the forwarding conveyor 28 by addition of the additional ressing roll 32′ and backing roll 31′ (FIG. 7) arranged much like the above-described rolls 31 and 32 of FIG. 7 but located downstream of the carriage 43 and associated with the conveyor 28.

The structure and operation of the FIG. 13 structure is otherwise similar to those above-discussed with respect to FIGS. 1–12.

Although a particular preferred embodiment in the invention has been disclosed in detail for illustrative purposes, it will be recognized that variations or modifications of the disclosed apparatus, including the rearrangement of parts, lie within the scope of the present invention.

The embodiments of the invention in which a exclusive property or privilege is claimed are defined as follows:

1. A method for cutting off selected length panels from an indefinite length strip of fabric with minimum waste, the fabric being comprised of superposed longitudinally and transverse elongate elements defining light transmitting pores therebetween, wherein the transverse elements may deviate from strict perpendicularity to the length direction of the strip, e.g., may be skewed or bowed, such method comprising:

extending said strip of fabric along a path;

backlighting said fabric strip at a cutting station to provide a line of light spots extending transversely across said strip between adjacent transverse elements of said strip;

moving an optical sensing means and cutter means transversely across said fabric strip with said optical sensing means on the opposite side of said fabric from which said strip is backlighted, so as to observe said line of light spots;

simultaneously moving said optical sensing means and cutter means longitudinal of said strip to cut along said line of light spots despite deviation of said line from perpendicularity with the length of said strip.

2. The method of claim 1 in which said step of moving transversely includes producing an output from said optical sensing means variable with deviation of said line of light spots from perpendicularity with the length of the strip, said step of simultaneously moving longitudinally including the step of using said variation of said output to control said longitudinal movement of said cutter in a direction to reduce said deviation.

3. Apparatus for cutting off full width panels from an indefinite length strip of fabric with minimum waste, the fabric being comprised of superposed longitudinal and transverse elongate threads, wherein the transverse threads may deviate from strict perpendicularity to the length direction of the strip, e.g., may be skewed or bowed, the apparatus comprising:

support means defining a path along which said strip of fabric and the longitudinal threads thereof are to extend;

cutter means actuable for cutting threads of said strip to cut off a said panel from said strip;

transverse moving means for relatively moving said cutter means and strip in a direction transverse to the length of said strip to cut the full width of said strip and thereby separate a panel therefrom;

longitudinal moving means actuable for relatively moving said cutter means and strip in a direction longitudinal of said strip and therewith for enabling said cutter means to follow a given transverse thread, even a skewed or bowed transverse thread, as it cuts across the full width of the strip;

vision guided means having means for sensing and moving along said given thread in fixed closely adjacent relation to said cutter means and responsive to deviations, longitudinally of the strip, in the direction of said given transverse thread for actuating said longitudinal moving means to compensatingly longitudinally relatively move said cutter means and strip, and therewith enable said cutter means to cut said strip substantially along a said given transverse thread and at least substantially avoid cutting of adjacent transverse threads, despite substantial skewing or bowing of said transverse threads out of perpendicularity with said length direction of said strip.

4. The apparatus of claim 3 in which said support means comprise first conveyor means for advancing said fabric strip past a cutting station, and second conveyor means for advancing cut panels to an unloading station.

5. The apparatus of claim 4 in which said support means include measuring means associated with said first conveyor means for passing substantially the desired length of fabric strip beyond said cutting station, said vision guided means including optical sensing means defining said means for sensing, said cutter means and optical sensing means being located at said cutting station.

6. Apparatus for cutting off selected length panels from an indefinite length strip of fabric with minimum waste, the fabric being comprised of superposed longitudinal and transverse elongate elements, wherein the transverse elements may deviate from strict perpendicularity to the length direction of the strip, e.g. may be skewed or bowed, the apparatus comprising:

support means defining a path along which said strip of fabric and the longitudinal elements thereof are to extend;

cutter means actuable for cutting elements of said strip to cut off a said panel from said strip;

transverse moving means for relatively moving said cutter means and strip in a direction transverse to the length of said strip to cut the full width of said strip and thereby separate a panel therefrom;

longitudinal moving means actuable for relatively moving said cutter means and strip in a direction longitudinal of said strip;

vision guided means optically responsive to deviations in the direction of at least one of said transverse elements adjacent said cutting means for actuating said longitudinal moving means to relatively move said cutter means and strip to enable said cutter means to cut said strip substantially along a single one of said transverse elements and at least substantially avoid cutting of transverse elements, despite substantial skewing or bowing of said transverse elements out of perpendicularity with said length direction of said strip, said vision guided means comprising optical sensing means aimed to view a portion of said fabric strip including said single transverse element and to produce an output signal varying with deviation of said transverse element from perpendicularity to the length direction of said fabric strip, and means responsive to said output signal of said optical sensing means for actuating said longitudinal moving means in a direction to reduce said deviation, said optical sensing means being mounted fixedly with respect to said cutter means for movement of the two together and with respect to said strip.

7. The apparatus of claim 6 in which said optical sensing means is aimed transversely ahead of said cutter means so as to view a portion of said fabric strip immediately prior to cutting through said portion by said cutter means.

8. The apparatus of claim 6 in which said vision guided means includes means controlling vision input to said optical sensing means so said optical sensing means sees a series of overlapping pictures successively taken across the width of said fabric strip and along said single transverse element thereof, each picture containing a fraction of the length of said transverse element, such that a change in the location in the picture of said transverse element, from one picture to the next, constitutes a said deviation to be reduced.

9. The apparatus of claim 8 in which said optical sensing means comprises a video camera aimed at said fabric strip, said means controlling vision input including lens means for said camera arranged so the field of view of the camera is small compared to the width of said fabric strip, that is so that several side-by-side camera fields occupy than the width than said strip.

10. Apparatus for cutting off selected length panels from an indefinite length strip of fabric with minimum waste, the fabric being comprised of superposed longitudinal and transverse elongate elements, wherein the transverse elements may deviate from strict perpendicularity to the length direction of the strip, e.g., may be skewed or bowed, the apparatus comprising:

support means defining a path along which said strip of fabric and the longitudinal elements thereof are to extend;

cutter means actuable for cutting elements of said strip to cut off a said panel from said strip;

transverse moving means for relatively moving said cutter means and strip in a direction transverse to the length of said strip to cut the full width of said strip and thereby separate a panel therefrom;

longitudinal moving means actuable for relatively moving said cutter means and strip in a direction longitudinal of said strip;

vision guided means optically responsive to deviations in the direction of at least one of said transverse elements adjacent said cutting means for actuating said longitudinal moving means to relatively move said cutter means and strip to enable said cutter means to cut said strip substantially along a single one of said transverse elements and at least substantially avoid cutting of transverse elements, despite substantial skewing or bowing of said transverse elements out of perpendicularity with said length direction of said strip, said fabric having pores each bounded by an adjacent pair of longitudinal elements and an adjacent pair of transverse elements, said vision guided means including optical sensing means and light source means located with respect to said support means, said fabric strip path extending between said optical sensing means and light source means so that said optical sensing means and light source means oppose opposite faces of said fabric strip, said light source means directly opposing said optical sensing means so as to shine on the latter through pores in the fabric.

11. Apparatus for cutting off selected length panels from an indefinite length strip of fabric with minimum waste, the fabric being comprised of superposed longitudinal and transverse elongate elements, wherein the transverse elements may deviate from strict perpendicularity to the length direction of the strip, e.g., may be skewed or bowed, the apparatus comprising:

support means defining a path along which said strip of fabric and the longitudinal elements thereof are to extend;

cutter means actuable for cutting elements of said strip to cut off a said panel from said strip;

transverse moving means for relatively moving said cutter means and strip in a direction transverse to the length of said strip to cut the full width of said strip and thereby separate a panel therefrom;

longitudinal moving means actuable for relatively moving said cutter means and strip in a direction longitudinal of said strip;

vision guided means optically responsive to deviations in the direction of at least one of said transverse elements adjacent said cutting means for actuating said longitudinal moving means to relatively move said cutter means and strip to enable said cutter means to cut said strip substantially along a single one of said transverse elements and at least substantially avoid cutting of transverse elements, despite substantial skewing or bowing of said transverse elements out of perpendicularity with said length direction of said strip, said fabric strip having pores each bounded by an adjacent pair of transverse elements and an adjacent pair of longitudinal elements, said vision guided means comprising a light source means and optical sensing means disposed on opposite sides of said path of said strip, said optical sensing means seeing at least one line of light spots extending along between an adjacent pair of transverse elements of said strip.

12. The apparatus of claim 11 in which said vision guided means comprises means responsive to an output signal of said optical sensing means for actuating said longitudinal moving means in a direction to reduce deviation of said line of light spots from perpendicularity with the length direction of said strip.

13. The apparatus of claim 11 in which said vision guided means includes means controlling vision input to said optical sensing means so said optical sensing means sees a series of overlapping pictures successively taken across the width of said fabric strip and along said line of light spots, each picture containing a fraction of the length of said line of light spots, such that a change in the location in the picture of said line of light spots, from one picture to the next, constitutes a deviation to be reduced.

14. The apparatus of claim 13 in which said optical sensing means comprises a video camera which senses said line of light spots, such that if a given horizontal location in successive fields cuts the line of light spots at different scan lines of the successive camera fields, the resulting video output from the camera represents a deviation of said line of light spots from perpendicularity to the length direction of said strip.

15. Apparatus for cutting off selected length panels from an indefinite length strip of fabric with minimum waste, the fabric being comprised of superposed longitudinal and transverse elongate elements, wherein the transverse elements may deviate from strict perpendicularity to the length direction of the strip, e.g., may be skewed or bowed, the apparatus comprising:

support means defining a path along which said strip of fabric and the longitudinal elements thereof are to extend;

cutter means actuable for cutting elements of said strip to cut off a said panel from said strip;

transverse moving means for relatively moving said cutter means and strip in a direction transverse to the length of said strip to cut the full width of said strip and thereby separate a panel therefrom;

longitudinal moving means actuable for relatively moving said cutter means and strip in a direction longitudinal of said strip;

vision guided means optically responsive to deviations in the direction of at least one of said transverse elements adjacent said cutting means for actuating said longitudinal moving means to relatively move said cutter means and strip to enable said cutter means to cut said strip substantially along a single one of said transverse elements and at least substantially avoid cutting of transverse elements, despite substantial skewing or bowing of said transverse elements out of perpendicularity with said length direction of said strip, including a cutting station located along said path of said strip of fabric, said vision guided means including optical sensing means, said cutter means and optical sensing means being located at said cutting station, said vision guided means further including light source means at said cutting station, said light source means and cutter means being on opposite sides of said fabric strip so said optical sensing means sees the fabric strip backlighted by said light source means, transparent means between said light source means and fabric strip and underlying the latter for supporting the fabric strip as it is advanced past said cutting station.

16. Apparatus for cutting off selected length panels from an indefinite length strip of fabric with minimum waste, the fabric being comprised of superposed longitudinal and transverse elongate elements, wherein the transverse elements may deviate from strict perpendicularity to the length direction of the strip, e.g., may be skewed or bowed, the apparatus comprising:

support means defining a path along which said strip of fabric and the longitudinal elements thereof are to extend;

cutter means actuable for cutting elements of said strip to cut off a said panel from said strip;

transverse moving means for relatively moving said cutter means and strip in a direction transverse to the length of said strip to cut the full width of said strip and thereby separate a panel therefrom;

longitudinal moving means actuable for relatively moving said cutter means and strip in a direction longitudinal of said strip;

vision guided means optically responsive to deviations in the direction of at least one of said transverse elements adjacent said cutting means for actuating said longitudinal moving means to relatively move said cutter means and strip to enable said cutter means to cut said strip substantially along a single one of said transverse elements and at least substantially avoid cutting of transverse elements, despite substantial skewing or bowing of said transverse elements out of perpendicularity with said length direction of said strip, said transverse moving means comprising transverse guide means extending transversely across said path of said fabric strip and fixed with respect to said path, transverse carriage means mounted to travel along said transverse guide means across said fabric strip, and transverse motor means for so moving said transverse carriage, said longitudinal moving means comprising longitudinal guide means fixed on said transverse carriage means and extending longitudinally of the path of said strip, longitudinal carriage means mounted on said longitudinal guide means for travelling with respect to said transverse carriage means in a direction along the length of said strip, and longitudinal motor means for so moving said longitudinal carriage, said cutter means being fixed on said longitudinal carriage, said longitudinal motor means being responsive to said vision guided means for actuating said longitudinal motor means to reduce said deviation.

17. The apparatus of claim 16 in which said vision guided means includes optical sensing means mounted on said longitudinal carriage fixedly with respect to said cutter means for movement together along a said transverse element of said strip despite bowing or skewing of said transverse element.

18. The apparatus of claim 17 in which said optical sensing means is aimed transversely ahead of said cutter means so as to view a portion of said fabric strip immediately prior to cutting through said portion by said cutter means.

19. Apparatus for cutting off selected length panels from an indefinite length strip of fabric with minimum waste, the fabric being comprised of superposed longitudinal and transverse elongate elements, wherein the transverse elements may deviate from strict perpendicularity to the length direction of the strip, e.g., may be skewed or bowed, the apparatus comprising:

support means defining a path along which said strip of fabric and the longitudinal elements thereof are to extend;

cutter means actuable for cutting elements of said strip to cut off a said panel from said strip;

a transverse element sensing means aimed to sense a said transverse element of said strip;

transverse moving means for relatively moving said transverse element sensing means and strip, in a direction transverse to the length of said strip, over the full width of said strip and length of said transverse element to produce an output signal varying with deviation of said transverse element from perpendicularity to the length direction of said fabric strip;

longitudinal moving means actuable for also moving said transverse element sensing means with respect to said path and strip in a direction longitudinal of said strip;

means responsive to said output signal of said sensing means for actuating said longitudinal moving means in a direction to cause said sensing means to track along said transverse element despite said deviation, said cutter means being mounted for movement with said sensing means along a said transverse element to enable said cutter means to cut said strip substantially along a said transverse element and at least substantially avoid cutting of neighboring transverse elements, despite substantial skewing or bowing of said transverse elements out of perpendicularity with said length direction of said strip.

20. The apparatus of claim 19 in which said transverse element sensing means comprising an optical sensing means capable of substantially continuously viewing a transverse element of said strip by viewing successive portions of said strip in sequence as said transverse moving means moves said optical sensing means transversely across said strip and along said transverse element.

21. The apparatus of claim 19 in which said transverse element is a transverse thread of said fabric strip, said sensing means being a thread sensing means, means mounting said thread sensing means and cutter means on both said longitudinal moving means and transverse moving means for moving said cutter means transversely across said strip while simultaneously moving same longitudinally of said strip to the extent required to cut alongside even a bowed or skewed transverse thread.

22. Apparatus for cutting off a piece from an indefinite length strip of fabric with minimum waste, the fabric being comprised of superposed elongate elements of two kinds, namely superposed longitudinal and transverse elongate elements, wherein the elements may be skewed or bowed, the apparatus comprising:

support means defining a path along which said strip of fabric and the longitudinal elements thereof are to extend;

cutter means actuable for cutting one said kind of elements of said strip to cut off a said piece from said strip;

transverse moving means for relatively moving said cutter means and strip in a direction transverse to the length of said strip;

longitudinal moving means actuable for relatively moving said cutter means and strip in a direction longitudinal of said strip;

vision guided means optically responsive to deviations in the direction of said elements of said one kind, located adjacent said cutting means, for actuating one of said moving means to relatively move said cutter means and strip to enable said cutter means to cut said strip substantially along a single one of said elements of said one kind and to at least substantially avoid cutting of elements of the other kind, despite substantial skewing or bowing of the said elements of said one kind and thereby to cut a piece from said strip substantially without cutting elements of said one kind, said fabric having pores each bounded by an adjacent pair of longitudinal elements and an adjacent pair of transverse elements, said vision guided means including optical sensing means and light source means located with respect to said support means, said fabric strip path extending between said optical sensing means and light source means so that said optical sensing means and light source means oppose opposite faces of said fabric strip, said light source means directly opposing said optical sensing means so as to shine on the latter through pores in the fabric, said optical sensing means seeing at least one line of light spots extending along between an adjacent pair of elements of said one kind in said strip.

23. The apparatus of claim 2 in which said elements of said one kind are transverse elements and said one moving means is said longitudinal moving means, said piece to be cut from said strip being a selected length panel to be cut from the free end of the strip of fabric along a desired transverse element despite deviation of such transverse element from strict perpendicularity to the length direction of the strip.

24. The apparatus of claim 22 in which said one kind of elements are longitudinal elements of the strip, said one moving means being said transverse moving means, said vision guided means being responsive to deviations in the direction of at least said one line of light spots extending between an adjacent pair of said longitudinal elements for actuating said transverse moving means to relatively move said cutter means and strip to enable said cutter means to cut said strip in a longitudinal slitting manner along one said longitudinal element and wherein said piece is substantially free of cut longitudinal elements.

25. The apparatus of claim 22 in which said transverse moving means comprises a carriage mounted for movement transversely of said strip and of said path defined by said support means, said cutter means being supported on said carriage and oriented for cutting longitudinally of the strip in a slitting manner, said strip being movable longitudinally along said path and past said carriage, said optical sensing means being mounted on said carriage adjacent said cutting means and being aligned therewith longitudinally of said path, said optical sensing means being positioned upstream of said cutting means along said path so as to cause a portion of the strip to pass said first optical sensing means and then said cutting means, such that bowing or skewing of longitudinal elements of said strip passing beneath said optical sensing means cause said carriage to shift transversely in a compensating manner, and therewith causing said cutting means to cut along, rather than through, an opposed longitudinal element of said strip despite said bowing or skewing of said opposed longitudinal element.

* * * * *

UNITED STATES PATENT AND TRADEMARK OFFICE

CERTIFICATE OF CORRECTION

PATENT NO. : 4 833 957

DATED : May 30, 1989

INVENTOR(S) : Bryan Lundgren

It is certified that error appears in the above-identified patent and that said Letters Patent is hereby corrected as shown below:

Col. 19, line 31; change "apparatus of claim 2" to ---apparatus of claim 22---.

Signed and Sealed this

Twenty-second Day of May, 1990

*Attest:*

HARRY F. MANBECK, JR.

*Attesting Officer*

*Commissioner of Patents and Trademarks*